US005092792A

United States Patent [19]

Nilsson

[11] Patent Number: 5,092,792

[45] Date of Patent: Mar. 3, 1992

[54] CONNECTOR FOR ELECTRIC CABLES AND A TOOL FOR ASSEMBLING THE CONNECTOR

[75] Inventor: Uno Nilsson, Saltsjo-Boo, Sweden

[73] Assignee: Molex Incorporated, Lisle, Ill.

[21] Appl. No.: 591,328

[22] Filed: Sep. 26, 1990

[30] Foreign Application Priority Data

Oct. 10, 1989 [SE] Sweden ..... 8903319

[51] Int. Cl.[5] ..... H01R 4/24

[52] U.S. Cl. ..... 439/403

[58] Field of Search ..... 439/389–425

[56] References Cited

U.S. PATENT DOCUMENTS 3,858,158 12/1974 Henn et al. ..... 439/403
3,923,362 12/1975 Dunn et al. ..... 439/403
4,036,547 7/1977 Nijman ..... 439/404
4,127,312 11/1978 Fleischhacker et al. ..... 439/403
4,552,429 11/1985 van Alst ..... 439/403

*Primary Examiner*—Joseph H. McGlynn
*Attorney, Agent, or Firm*—Louis A. Hecht; A. A. Tirva; Stephen Z. Weiss

[57] ABSTRACT

The invention concerns a connector for a multiwire electric cables and comprises two elongate covers inside of each there is located a cable wire conduit on which incoming and outgoing wires, respectively, are secured. A coupling plate is disposed between the two wire conduits for interconnecting the incoming and outgoing wires. The interconnection is made by utilizing insulation displacement contacts having slots extending inward from both ends.

25 Claims, 5 Drawing Sheets

CONNECTOR FOR ELECTRIC CABLES AND A TOOL FOR ASSEMBLING THE CONNECTOR

FIELD OF THE INVENTION

The present invention generally relates to a connector for electric cables, and more specifically to a connector for multiwire cable and a tool for assembling the connector. The invention can be utilized for connecting a cabinet having electronic contents to a network, for example, in a telephone exchange. In such case, the connector may be delivered to the site partially assembled.

BACKGROUND OF THE INVENTION

U.S. Pat. No. 3,489,986 shows a connector having two halves, wherein a plurality of contacts in one of the halves are connected to electric conductors at one end of the cable and contacts in an identical half are in a similar manner connected to the end of another cable. The contacts are oriented so as to lie opposite each other in the connector halves and are flexed into contact with each other so as to provide a detachable electrical connection between the conductors and the cables. Interconnecting the contacts is carried out by means of cards provided with apertures and being displaceable longitudinally.

SUMMARY OF THE INVENTION

The connector in accordance with the present invention includes two elongate covers which may be clamped together, a conduit for cable wire lying inside each cover and fitting into the respective cover, and a coupling plate fitting between the two wire conduits. The coupling plate has a plurality of insulation displacement terminals or slot contacts facing the respective wire conduits, each for electrically connecting a wire from both cables.

The tool utilized for assembling the connector in accordance with the invention is characterized in that it comprises two side walls held together by a bottom wall and has two rollers mounted between the side walls and adapted to engage one of the covers of the connector. A third roller is dimensioned so as to be received in a recess in each of the side walls of the tool and to engage the other cover of the connector in order to terminate the contacts to the wires and fit the two covers together.

BRIEF DESCRIPTION OF THE DRAWINGS

The invention will be described more specifically hereinafter with reference to the accompanying drawings, in which.

DETAILED DESCRIPTION OF THE PREFERRED EMBODIMENT

Figure 1:
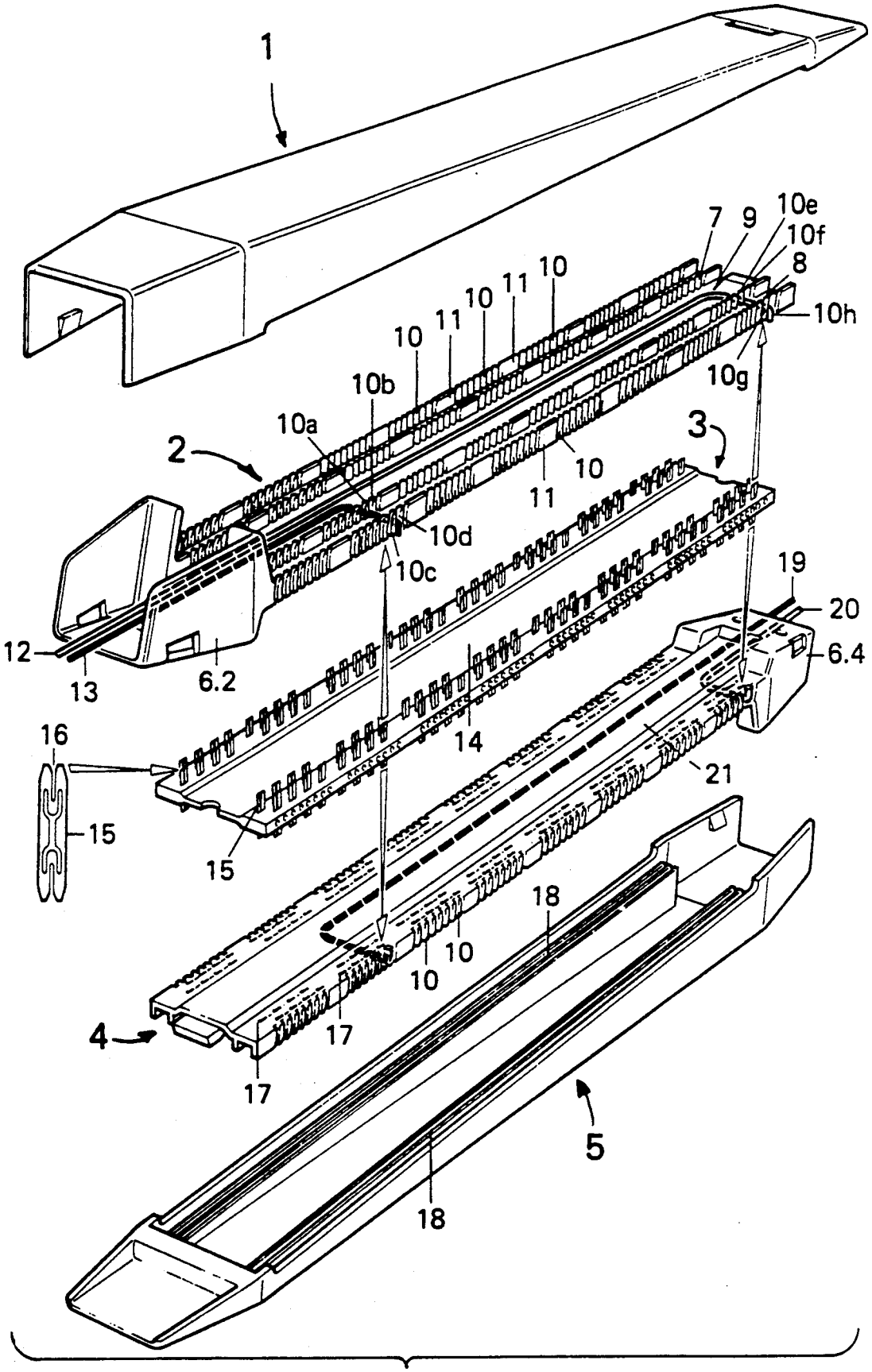
FIG. 1 shows the components of the connector of the invention in a perspective, exploded view.

The connector illustrated in FIG. 1 comprises an upper cover 1, an upper wire conduit 2, a coupling plate 3, a lower wire conduit 4 and a lower cover 5. The covers 1 and 5 are elongate, and in their operative position are inverted and rotated 180 degrees relative to each other in their longitudinal directions. They are preferably identical and their height tapers from one end to the other. They also may have clips or other known devices so that they can be clamped together.

The upper and lower wire conduits 2 and 4, respectfully, are identical and in their operative position are inverted and rotated 180 degrees relative to each other in their longitudinal directions. As best shown in FIG. 1, each wire conduit comprises a head portion *7a* and a pair of longitudinal channels 7 and 8, which are located on each side of an intermediate channel 9. The channels 7 and 8 are bordered and defined by groups of pins 10 extending at right angles to the longitudinal direction of the wire conduit. As shown in FIG. 1, there are eight groups of eight pins, with each individual group of pins separated by spacers 11.

FIG. 1 shows conduit 2 having two incoming wires 12 and 13 which comprise a portion of a cable (not shown). The wires 12 and 13 first extend longitudinally in intermediate channel 9 and thereafter are oriented from the intermediate channel 9 towards one side of the wire conduit. Each wire is then secured between two pairs of pins 10, viz. 10*a*, 10*b* and 10*c*, 10*d* as well as 10*e*, 10*f* and 10*g*, 10*h*, respectively. In like manner, additional wires are introduced into intermediate conduit 9 and each wire is directed towards channel 7 or channel 8 until a wire is located between all of the pins 10 or as many wires as desired. Each channel is formed by rows of pins 10 and spacers 11. In the embodiment illustrated in FIG. 1, each row is formed with eight groups of seven pins 10 separated by seven spacers 11. Accordingly, sixty-four wires can be secured to channel 7 and equal number to channel 8.

In FIG. 1, the ends of wires 12 and 13 are shown as having been severed essentially along the bottom edge of the side of wire conduit 2. This severing may be achieved by means of the device illustrated in FIG. 2 which will be described more specifically below. In order to securely fasten wires 12 and 13 to pins 10 of wire conduit 2, it may be desirable to slant the pins approximately 30 degrees in the longitudinal direction of the wire conduits. That is, pins 10 are in a plane perpendicular to the general plane of the conduit but may be slanted towards one end of the conduit. In the embodiment shown, the pins are slanted approximately 30 degrees away from head portion *7a* of wire conduit 2 towards the other end of the wire conduit.

The coupling plate 3 has an elongated plinth mounting 14, for example of plastic, which is penetrated in its transverse direction by a predetermined number of slot or insulation displacement contacts 15. Two contacts 15 are positioned adjacent to each other in coupling plate 3 so that both engage one wire as a security measure. Therefore, the number of contacts 15 is twice as great as the number of wires that may be utilized in one wire conduit.

To assemble the connector, the coupling plate 3 is moved upwardly towards wire conduit 2 from below (FIG. 1) so that the top portion of slot contacts 15 extend through slots 17 in wire conduit 2 and cut through the insulation of those wires which are located between the pins 10 in the wire conduit. Cover 1 is preferably mated to wire conduit 2 prior to mating conduit 2 with coupling plate 3 as covers 1 and 5 are provided with longitudinal ribs 18 on their inner surface to engage the wires in channels 7 and 8 to support and hold the wires while the slot contacts 15 penetrate the insulation of the wires. Through such a device, electric contact occurs between the wires and the corresponding slot contacts.

Assembly up to the point described above can be carried out in a plant where an assembler can work under quiet conditions. In reality it will be found that the results are better with regard to quality and with regard to cost if as much of the work as possible can be carried out in a plant.

In a manner corresponding to that described above, wires 19 and 20 are passed into an intermediate channel 21 of conduit 4 and then to pins 10 and are secured in the manner disclosed with regard to conduit 2. The wires could comprise a portion of a cable (not shown) running for example from electronic equipment to a telephone exchange.

Figure 2:
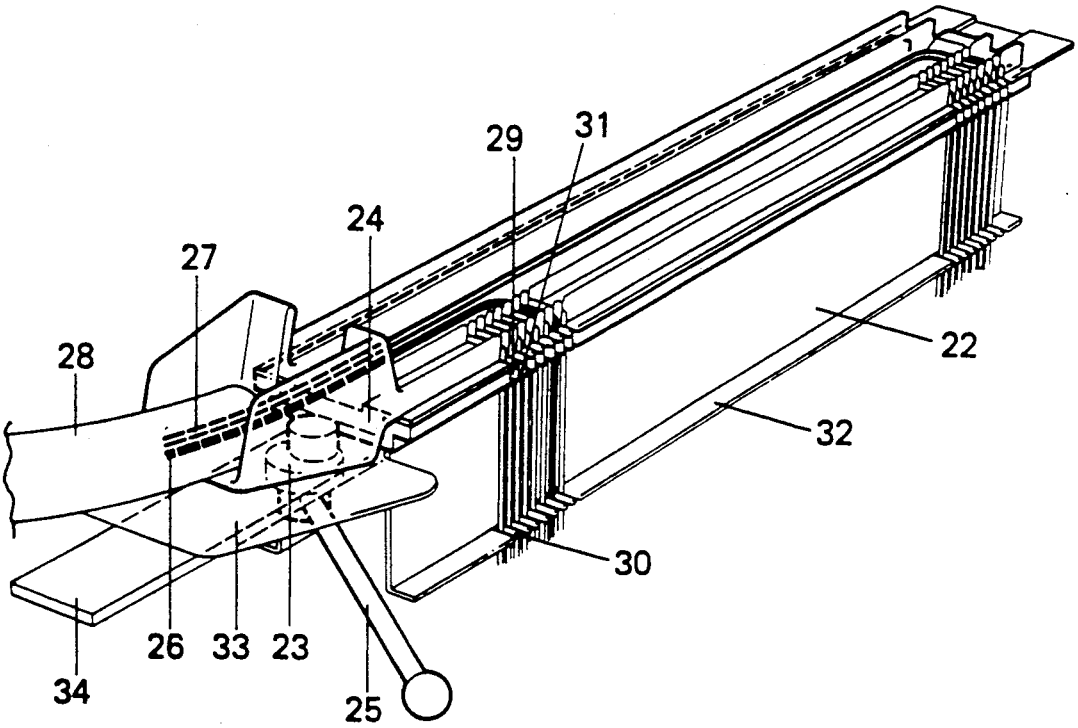
FIG. 2 is a perspective view of a device for severing wires during the assembly process of the connector.

By means of the device in accordance with FIG. 2, the wire are cut to the desired length. Cover 5 and wire conduit 4 are then placed together and the ribs 18 of the cover act to support and hold the wires in the wire conduit. The assembly of cover 5 and wire conduit 4 can be urged towards the coupling plate 3 whereby the lower slot 16 of the contact 15 displaces the insulation of wires 19 and 20 so as to create an electrical connection between each wire and its corresponding contact 15 and thus between wires 12 and 20 and between wires 13 and 19.

It is important to note that the total length of all of the interconnected wires will be the same as a result of the design of the connector. That is, the length of wire 19 which runs in wire conduit 4 plus the length of wire 13 of wire conduit 2 will be the same as the length of wire 12 which runs in wire conduit 2 plus the length of wire 20 in wire conduit 4.

As discussed above, the severing device shown in FIG. 2 is used for adjusting the length of the wires to be connected to each other through the connector of the invention. The severing device 13 formed of a base 22 having a profile similar to an inverted U and a severing plate 24. The intermediate shank of said base can be made to move along the severing plate 24 by means of an excentric 23 which is actuated by a lever 25. Incoming wires 26 and 27 in a cable 28 are introduced into recesses 29 in the severing plates 24 and 31 in the base 22 so that lengths of wires corresponding to the wire lengths which are to be utilized in the wire conduits 2 and 4 are obtained. Additionally, the ends of the wires are secured to recess 30 in the flange 32 at the base 22 of the severing device for tightening the wires so that they are exactly the right length. The designation 33 in FIG. 2 refers to a support plate for excentric 23 and the designation 34 shows a support bracket.

Figure 3:
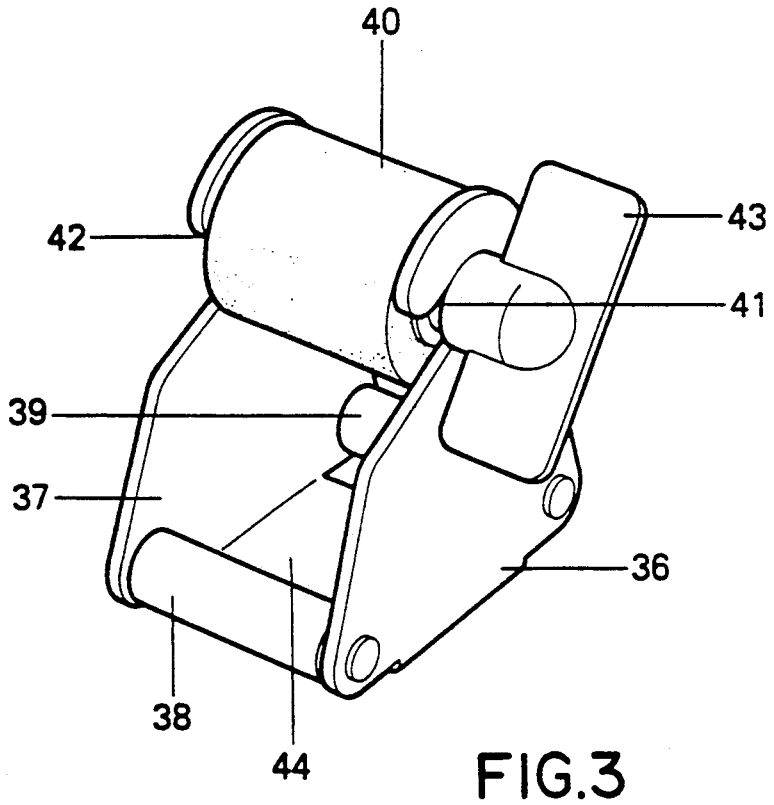
FIG. 3 is a perspective view of a tool disclosed for assembling the components of the connector in accordance with the invention.
Figure 4:
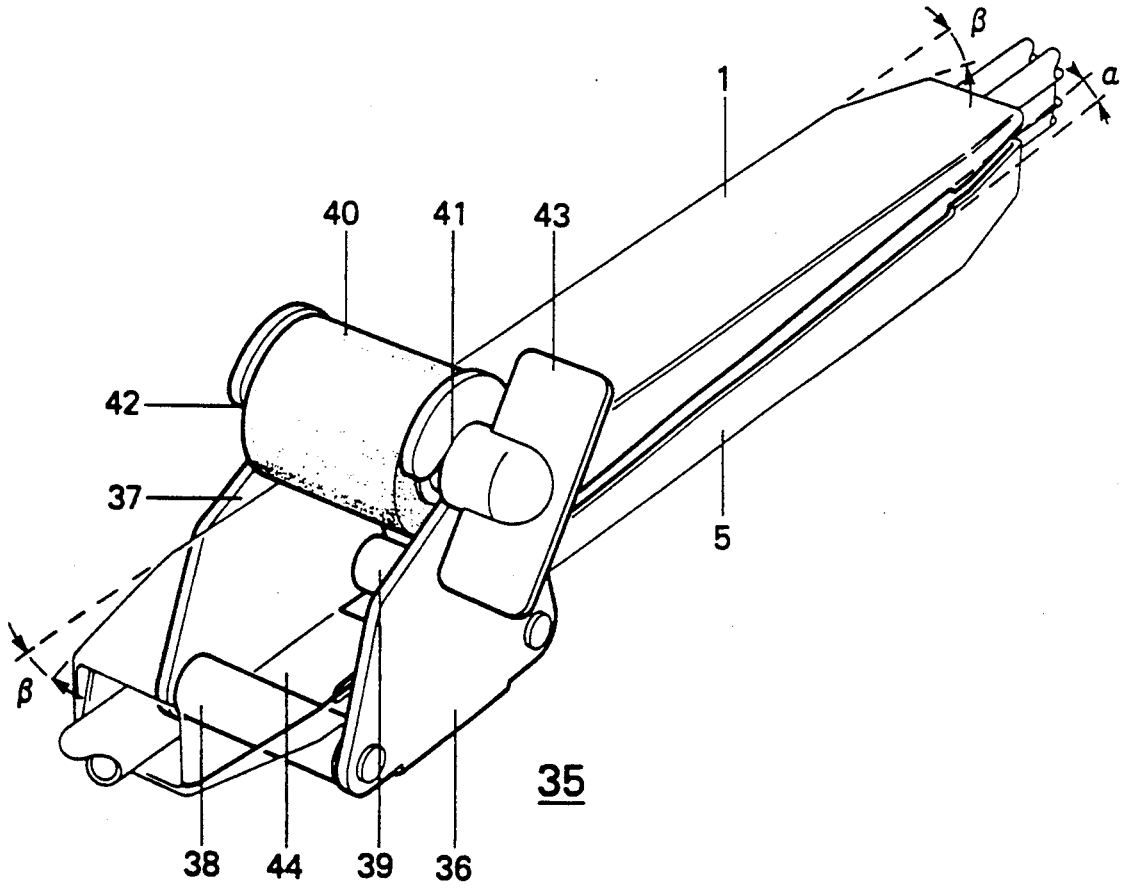
FIG. 4 is a perspective view of the tool of FIG. 3 in the process of assembling the connector.

In operation, it is very difficult to interconnect two connector halves of the present invention without a tool. Therefore, the invention also includes a small and handy tool for this purpose. Tools which have been used for the same purpose in other types of connectors have a tendency to become very large and difficult to handle. A tool 35 in accordance with the invention is shown alone in FIG. 3 and is shown in FIG. 4 in combination with a connector 36 of the present invention. Such a tool can be generally considered to operate in the nature of a can opener.

The tool has two side walls 36 and 37 interconnected by a bottom wall 44 and has two lower rollers 38 and 39 mounted therebetween which are intended to engage one of the covers of the connector, for example cover 5 (FIG. 4). An upper roller 40 is dimensioned to be received in recesses 41 and 42 in each of the side walls 36 and 37 of the tool and to engage the other cover 1 of the connector in order to close the covers and terminate the wires. The upper roller 40 is provided with a turning handle 43 so that the tool may be wound along the outsides of the two covers 1 and 5 so as to urge the ribs 18 located in the covers firmly against the wires since urging the tool 35 causes the contacts 15 to displace the insulation of the wires in the lower conduit 4 in order to complete the assembly and interconnect each wire in upper conduit 2 with its corresponding wire in lower conduit 4. In the description above it may be seen that assembling the three upper components of the connector has been assumed to have been carried out in a plant.

In FIG. 4, the two covers are shown as they have just begun to be interconnected by the tool 35 which has been placed at one end of the assembly. It can be seen that at the other end of the assembly, the covers are separated by an angle $\alpha$ which must become equal to zero in order to complete the assembly process. It can also be seen that at the ends of the cover, the side walls of the covers are tapered towards the center. The angle $\beta$ between the horizontal and the end of the cover has been utilized as 8 degrees but it is not limited to this value, and any desired angle can be used. The purpose of these tapered portions is to permit the tool 35 to easily engage the covers and begin to be wound.

The rollers 38, 39 and 40 can all consist of the same material, for example rubber, or they may be made of different materials. One or more of the rollers in FIGS. 3 and 4 can be provided with a groove in order to improve its grip against one of the covers or both of the covers in urging the connector components together. As may be seen from FIGS. 3 and 4, the upper roller 40 and its associated handle 43 may be removed from the side walls 36 and 37 through recesses 41 and 42.

When all of the components of the connector have been assembled in the positions illustrated in FIG. 4, the tool 35 is positioned on the connector. This is accomplished by slipping the tool onto the connector from below (FIG. 4) and thereafter sliding roller 40 through the recesses 41 and 42 in the side walls of the tool. The tool is slid onto the end portion of the connector assembly. If the handle 43 is turned in the right hand direction when viewed in FIG. 4, the tool will move along the connector, thereby urging the components of the connector together so that the angle $\alpha$ decrease until it eventually reaches zero. When fully assembled, the wires in the two cables will be interconnected sequentially and with great security and exactness even though only a low force has been applied. When the tool reaches the right hand end of the connector as viewed FIG. 4, it reaches the end portion having a taper of the angle $\beta$ and can easily be removed.

Figure 5:
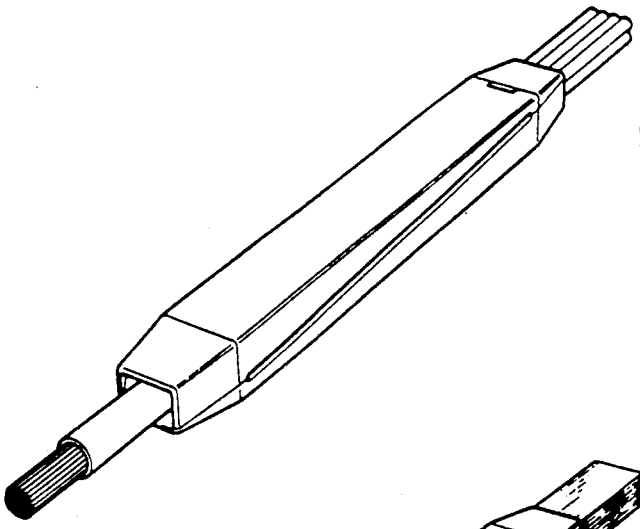
FIG. 5 is a perspective view of a fully assembled connector of the present invention having one cable at a first end and eight cables at the second end.

FIG. 5 shows the connector with 128 wires in a sheath cable at one end whereas the other end has eight cables, each of which contain 16 wires. In this case, assembly is carried out by placing one of the wire conduits in a support and the external sheath of each of the eight cables is removed without affecting the insulation on the sixteen wires of each cable. The wires of each cable are laced through the pins 10 of the conduit, whereafter the severing device shown in FIG. 2 is utilized to sever the extending wires.

The coupling plate 3 is positioned and the upper cover of the connector is positioned, whereafter the entire unit is clamped together. This may have been done in a plant, and what now remains is that the cable with 128 wires is to be connected to the connector at one end and to telephone exchange equipment, for example, at the other end. This is done in the telephone exchange in such a manner that the insulation sheath on the cable with 128 wires is removed without affecting the insulation of the individual wires. The wires are then laced into the other wire conduit and its mating cover is secured thereon. The assembly tool 35 is then used to clamp the two assemblies together.

Figure 6:
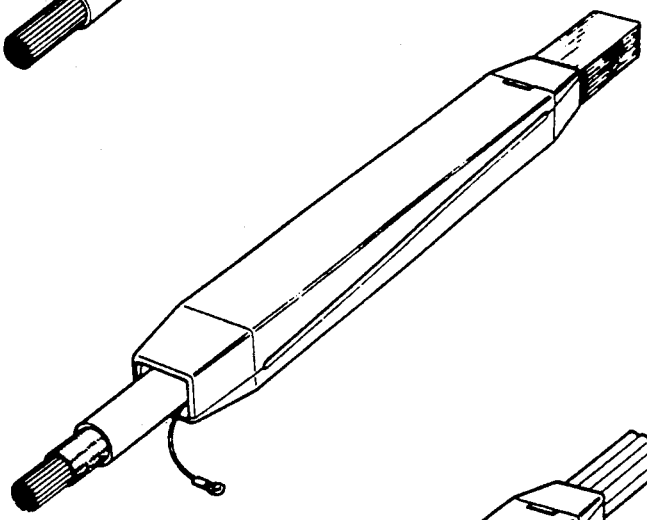
FIG. 6 is a perspective view of a fully assembled connector of the present invention having a shielded signal cable at a first end and a flat cable at the second end.
Figure 7:
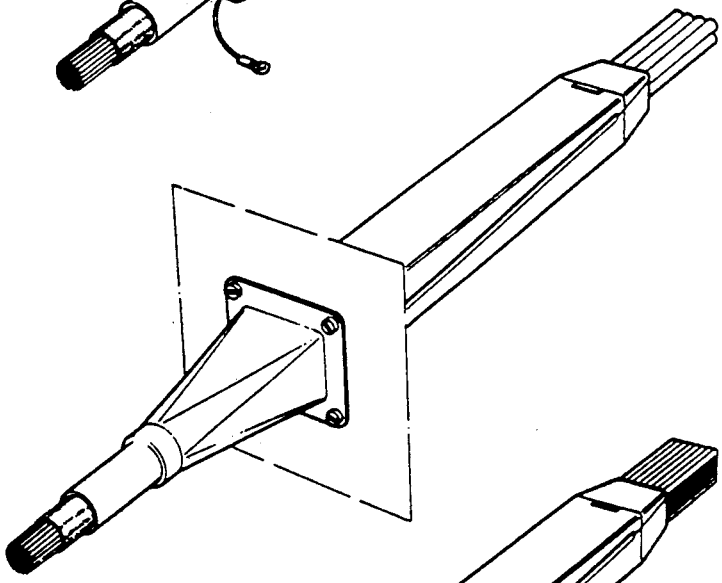
FIG. 7 is a perspective view of a fully assembled connector of the present invention having a shielded cable with a passage to a shielded area at a first end and eight cables at the second end.
Figure 8:
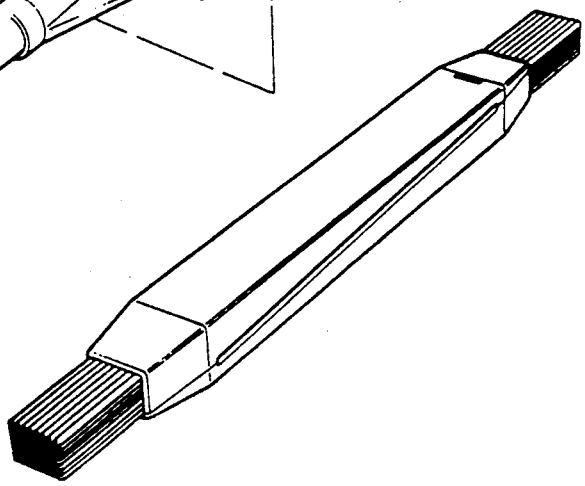
FIG. 8 is a perspective view of a fully assembled connector of the present invention having shielded twisted conductors at both ends.

FIG. 6 shows a connector of the present connector having an incoming shielded signal cable and an outgoing flat cable. FIG. 7 shows an incoming shielded cable having a passage to a shielded area and eight outgoing cables. FIG. 8 shows the incoming and outgoing cables as shielded twisted conductors, i.e., balanced lines.

It should be noted that the invention is not limited to the embodiments described above and illustrated in the drawings and that these merely comprise examples of the invention and its mode of utilization.

I claim:

1. An electrical connector for joining a first plurality of wires to a second plurality of wires, said connector comprising:

first and second elongated cover members;

first and second elongated conduit means, each being dimensioned to be received within one of said cover members;

each said conduit means comprising a longitudinal axis, first and second faces, a wire entry opening located generally along said axis at a first end of said conduit means through which a plurality of wires enter said conduit means, a wire receiving section located adjacent said wire entry opening in which a portion of each of said plurality of wires extends generally along said axis, a pair of wire terminating sections, each located on opposite sides of said wire receiving section, a plurality of terminal receiving slots extending through said conduit means between said first and second faces at said wire terminating section, and wire retaining means associated with each said wire terminating section for retaining a portion of each of said plurality of wires in said wire terminating section generally transverse to said axis, whereby each wire is associated with one of said slots;

a plurality of electrical contact terminals, each terminal having two end portions with insulation displacement means located at each end portion;

each wire of said first plurality of wires projecting through said wire entry opening of said first conduit means, along said wire receiving section of said first conduit means, and across one of said wire terminating sections, said wire being retained by said wire retaining means and each wire of said second plurality of wires projecting through said wire entry opening of said second conduit means, along said wire receiving section of said second conduit means, and across one of said wire terminating sections, said wire being retained by said wire retaining means, and one end portion of each said terminal penetrates through one of said slots in said first conduit means to engage a wire from said first plurality of wires retained across the wire terminating section to effect an insulation displacement engagement therebetween and the other end portion of each said terminal penetrates through one of said slots in said second conduit means to engage a wire of said second plurality of wires retained across the wire terminating section to effect an insulation displacement engagement therebetween, thereby electrically connecting individual wires from said first plurality of wires to individual wires of said second plurality of wires.

2. The connector of claim 1 wherein said cover members are hermaphroditic.

3. The connector of claim 1 wherein said conduit means are hermaphroditic.

4. The electrical connector of claim 1 wherein one of said cover members has a generally planar wire contacting means that contacts said wires and forces said wires of one of said pluralities of wires into said insulation displacement portion of said terminals to terminate said wires.

5. The connector according to claim 1 further comprising terminal retaining means dimensioned to fit between said first and second conduit means, said terminal retaining means having mounted thereon a plurality of said contact terminals whereby one end portion of each said contact terminal projects above an upper face of said terminal retaining means and the second end portion of each said contact terminal project below a lower face of said terminal retaining means.

6. The connector according to claim 5 wherein two contact terminals are electrically connected to each wire.

7. The connector according to claim 5 further comprising two wire terminating channels and a wire receiving channel oriented generally parallel to a longitudinal axis of said conduit means, a plurality of wires extend along said wire receiving channel and a predetermined number of said plurality of wires are laced across one wire terminating channel and the remaining wires of said plurality are laced across the other wire terminating channel.

8. The connector according to claim 7 wherein the portion of each said wire laced across said wire terminating channels is generally perpendicular to said longitudinal axis.

9. The connector of claim 7 wherein said cover further comprises longitudinal rib means for securing said wires to said conduit means during termination of said wires.

10. The connector of claim 7 wherein the total length of wire within said connector that is electrically connected to each terminal is substantially equal.

11. The connector according to claim 1 further comprising two wire terminating channels and a wire receiving channel oriented generally parallel to a longitudinal axis of said conduit means, a plurality of wires extend along said wire receiving channel and a predetermined number of said plurality of wires are laced across one wire terminating channel and the remaining wires of said plurality are laced across the other wire terminating channel.

12. The connector according to claim 11 wherein said channels are defined by a plurality of wire gripping pins.

13. The connector according to claim 12 wherein said wire gripping pins are oriented generally perpendicular to said first face of said conduit means.

14. The connector according to claim 13 wherein said wire gripping pins extend at an angle along said longitudinal axis toward said second end of said conduit means.

15. The connector according to claim 7 further comprising means for latching one of said conduit means to one said cover members to form a subassembly.

16. The connector according to claim 15 further comprising means for latching one subassembly to another subassembly.

17. The connector according to claim 7 wherein said channels are defined by a plurality of wire gripping pins that are oriented generally perpendicular to first face of said conduit means and the portion of each said wire laced across said wire terminating channels is generally perpendicular to said longitudinal axis.

18. The connector of claim 17 wherein said cover members are hermaphroditic and said conduit means are hermaphroditic.

19. The connector according to claim 17 further comprising means for latching one of said conduit means to one of said cover members to form a subassembly.

20. The connector according to claim 19 further comprising means for latching one subassembly to another subassembly.

21. The connector of claim 20 wherein said cover further comprising means for securing said wire to said conduit means during termination of said wires.

22. The connector of claim 21 wherein said securing means are longitudinal ribs.

23. The connector of claim 22 wherein said covers are tapered from a first end to a second end.

24. An electrical connector for joining a first plurality of wires to a second plurality of wires, said connector comprising:

first and second elongated conduit means;

each said conduit means comprising a longitudinal axis, a wire receiving face, a wire entry opening located generally along said axis at a first end of said conduit means through which a plurality of wires enter said conduit means, at least one wire terminating section and a wire receiving section, a portion of each of said plurality of wires extends generally along said axis adjacent said wire receiving face and through said wire receiving section, a plurality of terminal receiving slots extend through a portion of said conduit means at said wire terminating section, and wire retaining means associated with said wire terminating section for retaining a portion of each of said plurality of wires in said wire terminating section generally tranverse to said axis, whereby each wire is associated with one of said slots;

a plurality of electrical contact terminals, each terminal having two end portions with insulation displacement means located at each end portion;

each wire of said first plurality of wires projecting through said wire entry opening of said first conduit means, and along said wire receiving section of said first conduit means, and across one of said wire terminating sections, said wire being retained by said wire retaining means and each wire of said second plurality of wires projecting through said wire entry opening of said second conduit means, along said wire receiving section of said second conduit means, and across one of said wire terminating sections, said wire being retained by said wire retaining means, and one end portion of each said terminal extends into one of said slots in said first conduit means to engage a wire from said first plurality of wires retained across the wire terminating section to effect an insulation displacement engagement therebetween and the other end portion of each said terminal extends through one of said slots in said second conduit means to engage a wire of said second plurality of wires retained across the wire terminating section to effect an insulation displacement engagement therebetween, thereby electrically connecting individual wires from said first plurality of wires to individual wires of said second plurality of wires to create an electrically connected pair of wires, there being an electrical path defined by the distance along each wire of said first plurality of wires from said wire entry opening of said first conduit means to the terminal to which it is engaged plus the distance from that terminal to said wire entry opening of said second conduit means along the wire of said second plurality of wires that is also terminated to said terminal, the electrical paths for each pair of wires being substantially equal.

25. The electrical connector of claim 24 wherein said first and second conduit means are oriented such that the wire entry openings of each conduit means are located on opposite ends of said electrical connector.

* * * * *